US012798044B2

(12) United States Patent
Yagi et al.

(10) Patent No.: US 12,798,044 B2
(45) Date of Patent: Nov. 17, 2026

(54) POLISHING METHOD, COMPUTER-READABLE STORAGE MEDIUM STORING PROGRAM FOR OPERATING COMPUTER, AND POLISHING APPARATUS

(71) Applicant: EBARA CORPORATION, Tokyo (JP)

(72) Inventors: Keita Yagi, Tokyo (JP); Toshimitsu Sasaki, Tokyo (JP); Yoichi Shiokawa, Tokyo (JP); Yuki Watanabe, Tokyo (JP); Masashi Kabasawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 288 days.

(21) Appl. No.: 18/642,397

(22) Filed: Apr. 22, 2024

(65) Prior Publication Data

US 2024/0359290 A1 Oct. 31, 2024

(30) Foreign Application Priority Data

Apr. 27, 2023 (JP) ..... 2023-073547

(51) Int. Cl.
*B24B 49/05* (2006.01)
*B24B 49/04* (2006.01)
*B24B 49/12* (2006.01)

(52) U.S. Cl.
CPC ..... *B24B 49/04* (2013.01); *B24B 49/12* (2013.01)

(58) Field of Classification Search
CPC ..... B24B 49/04; B24B 49/12; B24B 49/05
See application file for complete search history.

(56) References Cited

U.S. PATENT DOCUMENTS 8,951,813 B2 * 2/2015 Iizumi ..... B24B 37/013 451/64
2012/0100642 A1 * 4/2012 Swedek ..... B24B 37/013 257/E21.53
2013/0273814 A1 * 10/2013 Kobayashi ..... B24B 37/013 451/6
2015/0017887 A1 * 1/2015 Kobayashi ..... B24B 37/013 451/73
2015/0255357 A1 * 9/2015 Kobayashi ..... B24B 37/005 156/345.13
2017/0148655 A1 * 5/2017 Kobayashi ..... B24B 37/013
2017/0190020 A1 * 7/2017 Kobayashi ..... B24B 37/013
(Continued)

FOREIGN PATENT DOCUMENTS

JP 6595987 B2 10/2019

*Primary Examiner* — Omar Flores Sanchez
(74) *Attorney, Agent, or Firm* — BakerHostetler

(57) ABSTRACT

A polishing method includes: during polishing of the workpiece, creating a reference spectrum history and a monitoring spectrum history by repeatedly producing a reference spectrum and a monitoring spectrum at two points on the workpiece; calculating a plurality of reference history differences that are differences between a latest monitoring spectrum and a plurality of reference spectra in the reference spectrum history; calculating a plurality of monitoring history differences that are differences between a latest reference spectrum and a plurality of monitoring spectra in the monitoring spectrum history; calculating a film-thickness difference between a monitoring point and a reference point based on a local minimum point of a reference history difference or a monitoring history difference.

10 Claims, 13 Drawing Sheets

(56) References Cited

U.S. PATENT DOCUMENTS

| | | | | |
|---|---|---|---|---|
| 2023/0139947 | A1* | 5/2023 | Ito | B24B 37/042<br>451/41 |
| 2024/0238934 | A1* | 7/2024 | Ota | B24B 37/013 |

* cited by examiner

POLISHING METHOD, COMPUTER-READABLE STORAGE MEDIUM STORING PROGRAM FOR OPERATING COMPUTER, AND POLISHING APPARATUS

CROSS REFERENCE TO RELATED APPLICATION

This document claims priority to Japanese Patent Application No. 2023-073547 filed Apr. 27, 2023, the entire contents of which are hereby incorporated by reference.

BACKGROUND

A chemical mechanical polishing (CMP) apparatus configured to polish a surface of a workpiece, such as a wafer, is used in a manufacturing process of semiconductor devices. The CMP apparatus includes a polishing pad attached to a polishing table, and a polishing head configured to press the workpiece against a polishing surface of the polishing pad. The CMP apparatus presses the workpiece against the polishing surface of the polishing pad by the polishing head while supplying a polishing liquid (e.g., slurry) onto the polishing pad to thereby place the surface of the workpiece in sliding contact with the polishing surface of the polishing pad. The surface of the workpiece is polished by a chemical action of the polishing liquid and mechanical action(s) of abrasive grains contained in the polishing liquid and/or the polishing pad.

Polishing of the workpiece is terminated when a film (e.g., a dielectric film, a silicon layer, etc.), constituting the surface of the workpiece, has been polished and a film thickness of the workpiece has reached a target film thickness. The polishing apparatus includes an optical film-thickness measuring device configured to measure the film thickness of the workpiece. The optical film-thickness measuring device is configured to direct light onto the workpiece and receive reflected light from the workpiece by an optical sensor head disposed in the polishing table, produce a spectrum of the reflected light from intensity of the reflected light, and determine the film thickness of the workpiece based on the spectrum of the reflected light.

An example of the technique of determining the film thickness based on the spectrum of the reflected light is shown in Japanese patent No. 6595987. This patent document discloses preparing a plurality of reference spectra by polishing in advance a reference wafer having the same structure as a target wafer to be polished, determining a reference spectrum which is closest in shape to the spectrum obtained during polishing of the target wafer, and determining a film thickness of the target wafer which is a film thickness associated with the determined reference spectrum.

However, in the conventional technique described above, it is necessary to polish the reference wafer in advance to obtain the plurality of reference spectra. Further, if there is a variation in a thickness of a lower layer which exists underneath the film constituting the surface of the target wafer to be polished, the film thickness of the target wafer may not be accurately measured. Furthermore, a quantity of light of a light source used in the optical film-thickness measuring device may decrease over time, so that a correction of the quantity of light may be required.

SUMMARY

There is provided a technique capable of eliminating polishing of a reference wafer in advance, and capable of obtaining a relative-film-thickness profile of a workpiece while the workpiece is polished.

Embodiments, which will be described below, relate to a technique of polishing a workpiece, such as a wafer, an interconnect substrate, a quadrangular substrate, and more particularly to a technique of creating a relative-film-thickness profile of the workpiece based on spectrum of reflected light from the workpiece during polishing of the workpiece.

In an embodiment, there is provided a polishing method comprising: polishing a workpiece by pressing the workpiece against a polishing pad while rotating a polishing table supporting the polishing pad; directing light to irradiation points including a reference point and a monitoring point on the workpiece during polishing of the workpiece; during polishing of the workpiece, creating a reference spectrum history including a plurality of reference spectra by repeatedly producing a reference spectrum that is a spectrum of reflected light from the reference point on the workpiece; during polishing of the workpiece, creating a monitoring spectrum history including a plurality of monitoring spectra by repeatedly producing a monitoring spectrum that is a spectrum of reflected light from the monitoring point on the workpiece; calculating a plurality of reference history differences that are differences between a latest monitoring spectrum and the plurality of reference spectra in the reference spectrum history; calculating a plurality of monitoring history differences that are differences between a latest reference spectrum and the plurality of monitoring spectra in the monitoring spectrum history; calculating a film-thickness difference between the monitoring point and the reference point based on a local minimum point of a reference history difference or a monitoring history difference that exists in either the plurality of reference history differences or the plurality of monitoring history differences; determining a plurality of film-thickness differences by calculating the film-thickness difference for a plurality of monitoring points on the workpiece; and creating a relative-film-thickness profile of the workpiece based on the plurality of film-thickness differences.

In an embodiment, the reference point comprises a central point of the workpiece.

In an embodiment, the reference point and the monitoring point comprise two adjacent points of the irradiation points.

In an embodiment, determining the plurality of film-thickness differences for the plurality of monitoring points comprises determining the plurality of film-thickness differences by calculating the film-thickness difference for the plurality of monitoring points on the workpiece while shifting the reference point and the monitoring point, which are adjacent, one by one within the irradiation points.

In an embodiment, calculating the film-thickness difference between the monitoring point and the reference point comprises: determining the local minimum point of the reference history difference or the monitoring history difference that exists in either the plurality of reference history differences or the plurality of monitoring history differences; determining a time difference between a past point in time corresponding to the local minimum point and a point in time at which the latest monitoring spectrum or the latest reference spectrum has been produced; and calculating the film-thickness difference by multiplying the time difference by a temporary polishing rate of the workpiece.

In an embodiment, the workpiece comprises a product wafer.

In an embodiment, there is provided a computer-readable storage medium storing a program for causing a computer to perform the steps of: instructing a light source to direct light to irradiation points including a reference point and a monitoring point on a workpiece during polishing of the workpiece; during polishing of the workpiece, creating a reference spectrum history including a plurality of reference spectra by repeatedly producing a reference spectrum that is a spectrum of reflected light from the reference point on the workpiece; during polishing of the workpiece, creating a monitoring spectrum history including a plurality of monitoring spectra by repeatedly producing a monitoring spectrum that is a spectrum of reflected light from the monitoring point on the workpiece; calculating a plurality of reference history differences that are differences between a latest monitoring spectrum and the plurality of reference spectra in the reference spectrum history; calculating a plurality of monitoring history differences that are differences between a latest reference spectrum and the plurality of monitoring spectra in the monitoring spectrum history; calculating a film-thickness difference between the monitoring point and the reference point based on a local minimum point of a reference history difference or a monitoring history difference that exists in either the plurality of reference history differences or the plurality of monitoring history differences; determining a plurality of film-thickness differences by calculating the film-thickness difference for a plurality of monitoring points on the workpiece; and creating a relative-film-thickness profile of the workpiece based on the plurality of film-thickness differences.

In an embodiment, calculating the film-thickness difference between the monitoring point and the reference point comprises: determining the local minimum point of the reference history difference or the monitoring history difference that exists in either the plurality of reference history differences or the plurality of monitoring history differences; determining a time difference between a past point in time corresponding to the local minimum point and a point in time at which the latest monitoring spectrum or the latest reference spectrum has been produced; and calculating the film-thickness difference by multiplying the time difference by a temporary polishing rate of the workpiece.

In one embodiment, there is provided a polishing apparatus comprising: a polishing table configured to support a polishing pad; a table motor configured to rotate the polishing table; a polishing head configured to polish a workpiece by pressing the workpiece against the polishing pad; a light source and an optical sensor head configured to direct light to irradiation points including a reference point and a monitoring point on the workpiece during polishing of the workpiece; and a processing system having a memory storing a program therein and an arithmetic device configured to perform an arithmetic operation according to an instruction contained in the program, wherein the processing system is configured to: create a reference spectrum history including a plurality of reference spectra by repeatedly producing a reference spectrum that is a spectrum of reflected light from the reference point on the workpiece during polishing of the workpiece; create a monitoring spectrum history including a plurality of monitoring spectra by repeatedly producing a monitoring spectrum that is a spectrum of reflected light from the monitoring point on the workpiece during polishing of the workpiece; calculate a plurality of reference history differences that are differences between a latest monitoring spectrum and the plurality of reference spectra in the reference spectrum history; calculate a plurality of monitoring history differences that are differences between a latest reference spectrum and the plurality of monitoring spectra in the monitoring spectrum history; calculate a film-thickness difference between the monitoring point and the reference point based on a local minimum point of a reference history difference or a monitoring history difference that exists in either the plurality of reference history differences or the plurality of monitoring history differences; determine a plurality of film-thickness differences by calculating the film-thickness difference for a plurality of monitoring points on the workpiece; and create a relative-film-thickness profile of the workpiece based on the plurality of film-thickness differences.

In an embodiment, the processing system is configured to: determine the local minimum point of the reference history difference or the monitoring history difference that exists in either the plurality of reference history differences or the plurality of monitoring history differences; determine a time difference between a past point in time corresponding to the local minimum point and a point in time at which the latest monitoring spectrum or the latest reference spectrum has been produced; and calculate the film-thickness difference by multiplying the time difference by a temporary polishing rate of the workpiece.

Both the reference point and the monitoring point are located on the same workpiece. During polishing of the workpiece, the reference spectrum at the reference point and the monitoring spectrum at the monitoring point are produced, and the relative-film-thickness profile is created based on a comparison between the reference spectrum and the monitoring spectrum. Therefore, it is not necessary to polish another workpiece in advance. Furthermore, an influence of a lower layer, which exists underneath a film constituting the surface of the workpiece, is canceled by calculating the difference between the reference spectrum and the monitoring spectrum. Therefore, measuring of the film-thickness of the workpiece is less affected by a variation in the lower layer.

DESCRIPTION OF EMBODIMENTS

Figure 1:
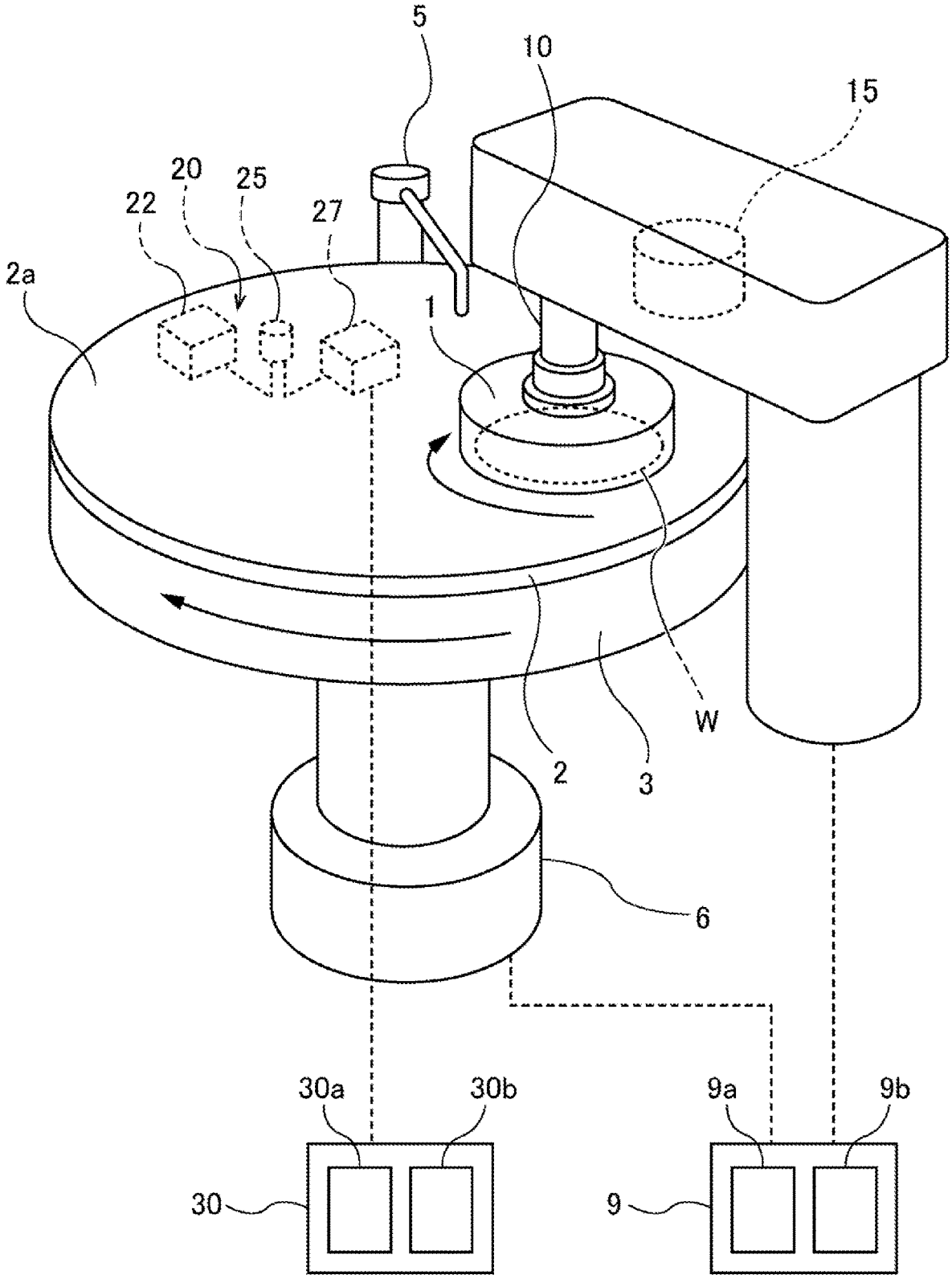
FIG. 1 is a schematic diagram showing an embodiment of a polishing apparatus.

Embodiments will now be described with reference to the drawings. FIG. 1 is a schematic diagram showing an embodiment of a polishing apparatus. As shown in FIG. 1, the polishing apparatus includes a polishing table 3 configured to support a polishing pad 2, a polishing head 1 configured to press a workpiece W against the polishing pad 2, a table motor 6 configured to rotate the polishing table 3, a polishing-liquid supply nozzle 5 configured to supply a polishing liquid, such as slurry, onto the polishing pad 2, and an operation controller 9 configured to control operations of the polishing apparatus. The polishing pad 2 has an upper surface constituting a polishing surface 2*a* for polishing the workpiece W. The workpiece W has a film forming an interconnect structure on its surface. Examples of the workpiece W include a wafer, an interconnect substrate, a quadrangular substrate, etc., for use in manufacturing of semiconductor devices. In one example, the workpiece W is a product wafer on which multilayered films are formed.

The polishing head 1 is coupled to a head shaft 10, and the head shaft 10 is coupled to a polishing-head rotating device 15. The polishing-head rotating device 15 is configured to rotate the polishing head 1 together with the head shaft 10 in a direction indicated by an arrow. The configuration of the polishing-head rotating device 15 is not particularly limited. In an example, the polishing-head rotating device 15 includes an electric motor, a belt, and pulleys. The polishing table 3 is coupled to the table motor 6, and the table motor 6 is configured to rotate the polishing table 3 and the polishing pad 2 in a direction indicated by an arrow. The polishing head 1, the polishing-head rotating device 15, and the table motor 6 are coupled to the operation controller 9.

Polishing of the workpiece W is performed as follows. The polishing liquid is supplied from the polishing-liquid supply nozzle 5 onto the polishing surface 2*a* of the polishing pad 2 on the polishing table 3, while the table motor 6 and the polishing-head rotating device 15 rotate the polishing table 3 and the polishing head 1 in the directions indicated by the arrows in FIG. 1. The workpiece W is pressed against the polishing surface 2*a* of the polishing pad 2 by the polishing head 1 in the presence of the polishing liquid on the polishing pad 2, while the workpiece W is being rotated by the polishing head 1. The surface of the workpiece W is polished by a chemical action of the polishing liquid and mechanical action(s) of abrasive grains contained in the polishing liquid and/or the polishing pad 2.

The operation controller 9 includes a memory 9*a* storing programs therein, and an arithmetic device 9*b* configured to perform arithmetic operations according to instructions contained in the programs. The operation controller 9 is composed of at least one computer. The memory 9*a* includes a main memory, such as a random-access memory (RAM), and an auxiliary memory, such as a hard disk drive (HDD) or a solid state drive (SSD). Examples of the arithmetic device 9*b* include a CPU (central processing unit) and a GPU (graphic processing unit). However, the specific configuration of the operation controller 9 is not limited to these examples.

The polishing apparatus includes an optical profile measuring device 20 configured to create a relative-film-thickness profile of the workpiece W. The optical profile measuring device 20 includes a light source 22 configured to emit light, an optical sensor head 25 configured to direct the light of the light source 22 to the workpiece W and receive reflected light from the workpiece W, a spectrometer 27 coupled to the optical sensor head 25, and a processing system 30 configured to create a relative-film-thickness profile of the workpiece W based on spectra of the reflected light from the workpiece W. The optical sensor head 25 is disposed in the polishing table 3, and rotates together with the polishing table 3.

The processing system 30 includes a memory 30*a* storing programs therein, and an arithmetic device 30*b* configured to perform arithmetic operations according to instructions contained in the programs. The processing system 30 is composed of at least one computer. The memory 30*a* includes a main memory, such as a random-access memory (RAM), and an auxiliary memory, such as a hard disk drive (HDD) or a solid state drive (SSD). Examples of the arithmetic device 30*b* include a CPU (central processing unit) and a GPU (graphic processing unit). However, the specific configuration of the processing system 30 is not limited to these examples.

Each of the operation controller 9 and the processing system 30 may be composed of a plurality of computers. For example, each of the operation controller 9 and the processing system 30 may be configured of a combination of an edge server and a cloud server. In one embodiment, the operation controller 9 and the processing system 30 may be comprised of one computer.

Figure 2:
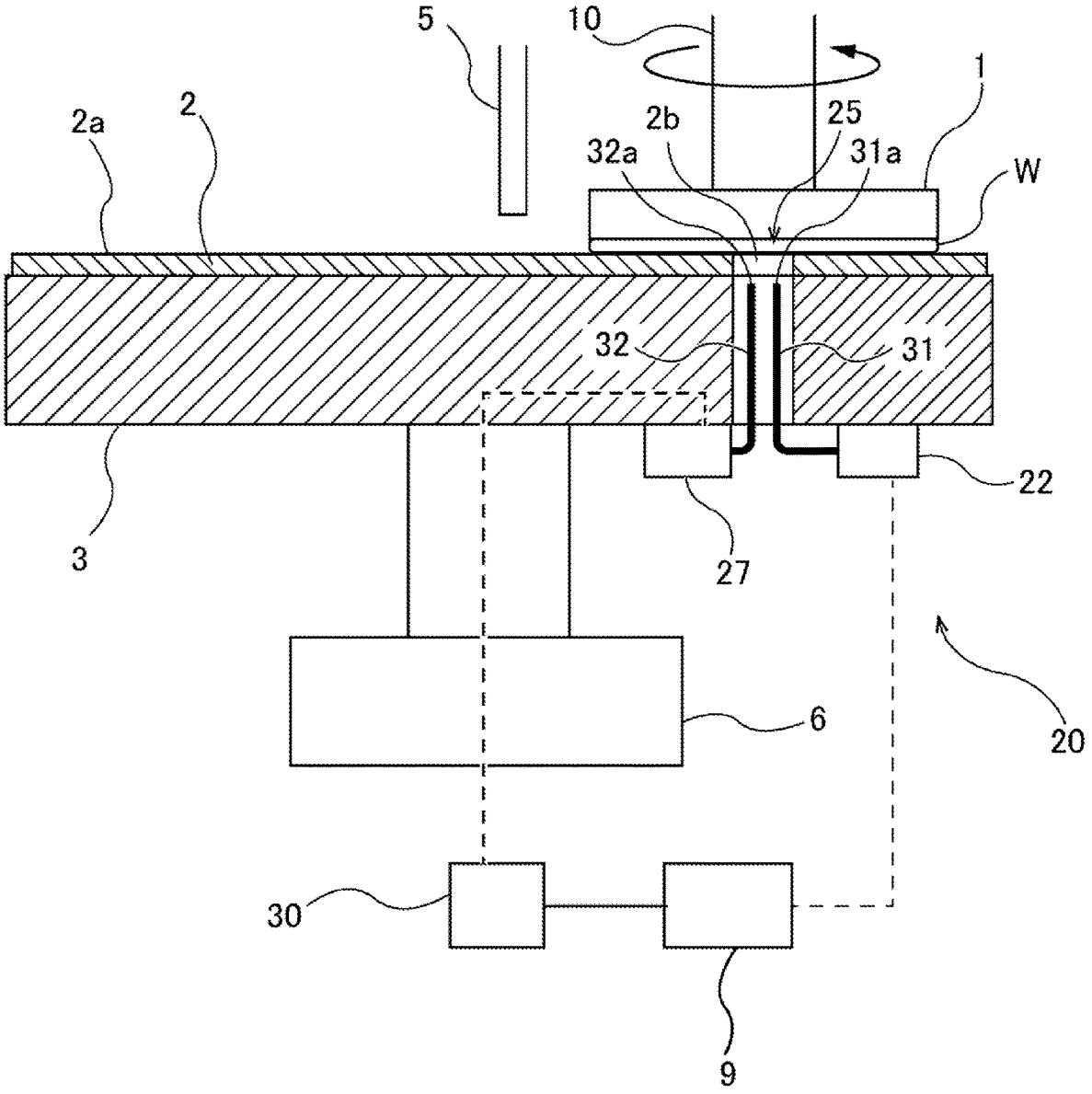
FIG. 2 is a cross-sectional view showing a detailed configuration of an optical profile measuring device.

FIG. 2 is a cross-sectional view showing a detailed configuration of the optical profile measuring device 20. The optical profile measuring device 20 includes an illuminating optical fiber cable 31 coupled to the light source 22, and a light-receiving optical fiber cable 32 coupled to the spectrometer 27. A distal end 31*a* of the illuminating optical fiber cable 31 and a distal end 32*a* of the light-receiving optical fiber cable 32 constitute the optical sensor head 25. Specifically, the illuminating optical fiber cable 31 directs the light emitted by the light source 22 to the workpiece W on the polishing pad 2, and the light-receiving optical fiber cable 32 receives the reflected light from the workpiece W and transmits the reflected light to the spectrometer 27.

The spectrometer 27 is coupled to the processing system 30. The illuminating optical fiber cable 31, the light-receiving optical fiber cable 32, the light source 22, and the spectrometer 27 are attached to the polishing table 3, and rotate together with the polishing table 3 and the polishing pad 2. The optical sensor head 25, which is constituted of the distal end 31*a* of the illuminating optical fiber cable 31 and the distal end 32*a* of the light-receiving optical fiber cable 32, is arranged so as to face the surface of the workpiece W on the polishing pad 2.

A position of the optical sensor head 25 is such that the optical sensor head 25 sweeps across the surface of the workpiece W on the polishing pad 2 each time the polishing table 3 and the polishing pad 2 make one revolution. The polishing pad 2 has a through-hole 2*b* located above the optical sensor head 25. The optical sensor head 25 directs the light to the workpiece W through the through-hole 2*b* each time the polishing table 3 makes one revolution, and receives the reflected light from the workpiece W through the through-hole 2*b*.

In one embodiment, a transparent window (not shown) may be disposed in the through-hole 2*b* of the polishing pad 2 so as to prevent the polishing liquid and polishing debris from contacting the optical sensor head 25. The transparent window is made of a material (e.g., transparent resin) that allows light to pass therethrough. In this case, the light is directed from the optical sensor head 25 through the transparent window to the workpiece W, and the reflected light from the workpiece W is received by the optical sensor head 25 through the transparent window.

The light source 22 is a flash light source that repeatedly emits light at short time intervals. An example of the light source 22 is a xenon flash lamp. The light source 22 is electrically coupled to the operation controller 9, and receives a trigger signal transmitted from the operation controller 9 to emit the light. More specifically, while the optical sensor head 25 traverses the surface of the workpiece W on the polishing pad 2, the light source 22 receives a plurality of trigger signals to emit the light multiple times. Therefore, each time the polishing table 3 makes one revolution, the light is directed to a plurality of irradiation points including a central point on the workpiece W.

The light emitted by the light source 22 is transmitted to the optical sensor head 25. Specifically, the light is transmitted through the illuminating optical fiber cable 31 to the optical sensor head 25, and is emitted from the optical sensor head 25. The light passes through the through-hole 2*b* (or the transparent window) of the polishing pad 2 to the workpiece W on the polishing pad 2. The light reflected from the workpiece W passes through the through-hole 2*b* (or the transparent window) of the polishing pad 2 again, and is received by the optical sensor head 25. The reflected light from the workpiece W is transmitted to the spectrometer 27 through the light-receiving optical fiber cable 32.

The spectrometer 27 is configured to decompose the reflected light according to wavelength, and measure an intensity of the reflected light at each of wavelengths over a predetermined wavelength range. Specifically, the spectrometer 27 decomposes the reflected light from the workpiece W according to wavelength and measures the intensity of the reflected light at each of wavelengths over the predetermined wavelength range to thereby generate light-intensity measurement data. The intensity of the reflected light at each of wavelengths may be represented as a relative value, such as a reflectance or a relative reflectance. The light-intensity measurement data is transmitted to the processing system 30.

Figure 3:
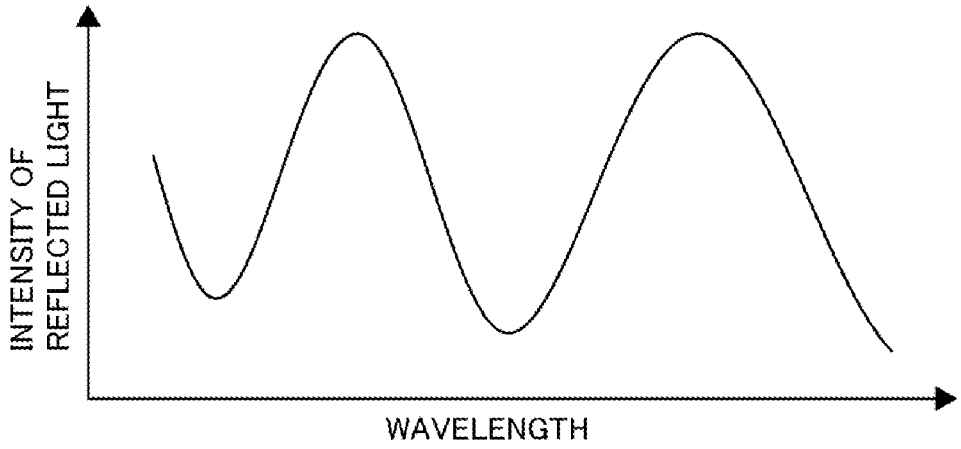
FIG. 3 is a schematic diagram showing an example of a spectrum produced from light-intensity measurement data.

The processing system 30 produces a spectrum of the reflected light as shown in FIG. 3 from the light-intensity measurement data. The spectrum of the reflected light from the workpiece W includes information on the film thickness of the workpiece W. In other words, the spectrum of the reflected light varies depending on the film thickness of the workpiece W. The processing system 30 is configured to create a relative-film-thickness profile of the workpiece W based on spectra of the reflected light.

Figure 4:
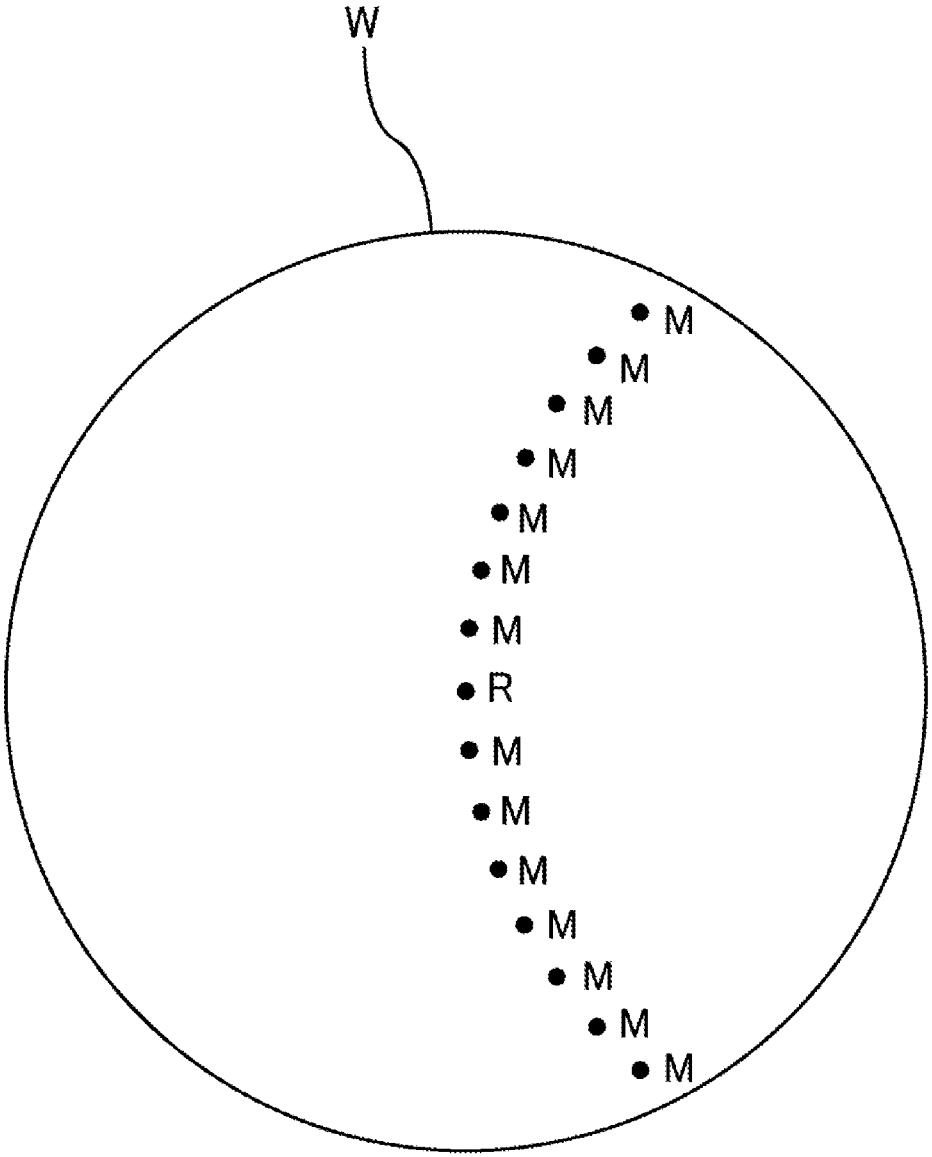
FIG. 4 is a diagram showing an example of irradiation points of light on a workpiece.

An embodiment of creating the relative-film-thickness profile of the workpiece W will be described below. FIG. 4 is a diagram showing an example of the irradiation points of the light on the workpiece W. As described above, during polishing of the workpiece W, the optical sensor head 25 directs the light to the surface of the workpiece W multiple times while the optical sensor head 25 moves across the surface of the workpiece W each time the polishing table 3 makes one revolution. Therefore, as shown in FIG. 4, a plurality of irradiation points R and M of the light from the optical sensor head 25 are aligned in a radial direction on the surface of the workpiece W. One irradiation point R of the plurality of irradiation points R and M is located on the central point of the workpiece W. The optical sensor head 25 receives the reflected light from the plurality of irradiation points R and M each time the polishing table 3 makes one revolution, and the processing system 30 produces a plurality of spectra of the reflected light from the plurality of irradiation points R and M.

The processing system 30 classifies the plurality of irradiation points R and M into a reference point R and monitoring points M. During polishing of the workpiece W, the processing system 30 creates a reference spectrum history including a plurality of reference spectra by repeatedly producing a reference spectrum that is a spectrum of the reflected light from the reference point R on the workpiece W. More specifically, during polishing of the workpiece W, the optical sensor head 25 repeatedly directs the light to the reference point R on the workpiece W at predetermined time intervals, and the processing system 30 repeatedly produces a reference spectrum, which is a spectrum of the reflected light from the reference point R, at the predetermined time intervals. The predetermined time interval is a time interval during which the polishing table 3 rotates a predetermined number of times. In this embodiment, the predetermined time interval is a time interval during which the polishing table 3 makes one revolution. Therefore, the processing system 30 creates the reference spectrum history including the plurality of reference spectra by repeatedly producing the reference spectrum each time the polishing table 3 makes one revolution.

The reference spectrum history is time-series data of the plurality of reference spectra obtained in the past. In this embodiment, the reference spectrum is produced each time the polishing table 3 makes one revolution, so that a newly produced reference spectrum is added to the reference spectrum history each time the polishing table 3 makes one revolution. The reference spectrum history is stored in the memory 30*a* of the processing system 30.

During polishing of the workpiece W, the processing system 30 creates a monitoring spectrum history for each monitoring point M that includes a plurality of monitoring spectra by repeatedly producing a monitoring spectrum that is a spectrum of the reflected light from each monitoring point M on the workpiece W. More specifically, during polishing of the workpiece W, the optical sensor head 25 repeatedly directs the light to each monitoring point M on the workpiece W at predetermined time intervals, and the processing system 30 repeatedly produces a monitoring spectrum that is a spectrum of the reflected light from the monitoring point M at predetermined time intervals. The predetermined time interval is a time interval during which the polishing table 3 rotates a predetermined number of times. In this embodiment, the predetermined time interval is a time interval during which the polishing table 3 makes one revolution. Therefore, the processing system 30 creates the monitoring spectrum history including the plurality of monitoring spectra for each monitoring point M by repeatedly producing the monitoring spectrum for each monitoring point M each time the polishing table 3 makes one revolution.

The monitoring spectrum history is time-series data of the plurality of monitoring spectra obtained in the past. In this embodiment, the monitoring spectrum is produced each time the polishing table 3 makes one rotation, so that a newly produced monitoring spectrum is added to the monitoring spectrum history each time the polishing table 3 makes one rotation. Since the monitoring spectrum is produced for each of the monitoring points M, a plurality of monitoring spectrum histories corresponding to the plurality of monitoring points M are created. The plurality of monitoring spectrum histories are stored in the memory 30*a* of the processing system 30.

The processing system 30 may create the reference spectrum history and the plurality of monitoring spectrum histories simultaneously, at different times, or in overlapping times.

During polishing of the workpiece W, the processing system 30 compares the monitoring spectrum produced from the reflected light from each of the monitoring points M with the plurality of reference spectra in the reference spectrum history. Specifically, the processing system 30 calculates a plurality of reference history differences that are differences between a latest monitoring spectrum in the monitoring spectrum history created for each of the monitoring points M and the plurality of reference spectra in the reference spectrum history. Each of the plurality of reference history differences is a difference in shape between the latest monitoring spectrum and each of the reference spectra in the reference spectrum history.

Figure 5:
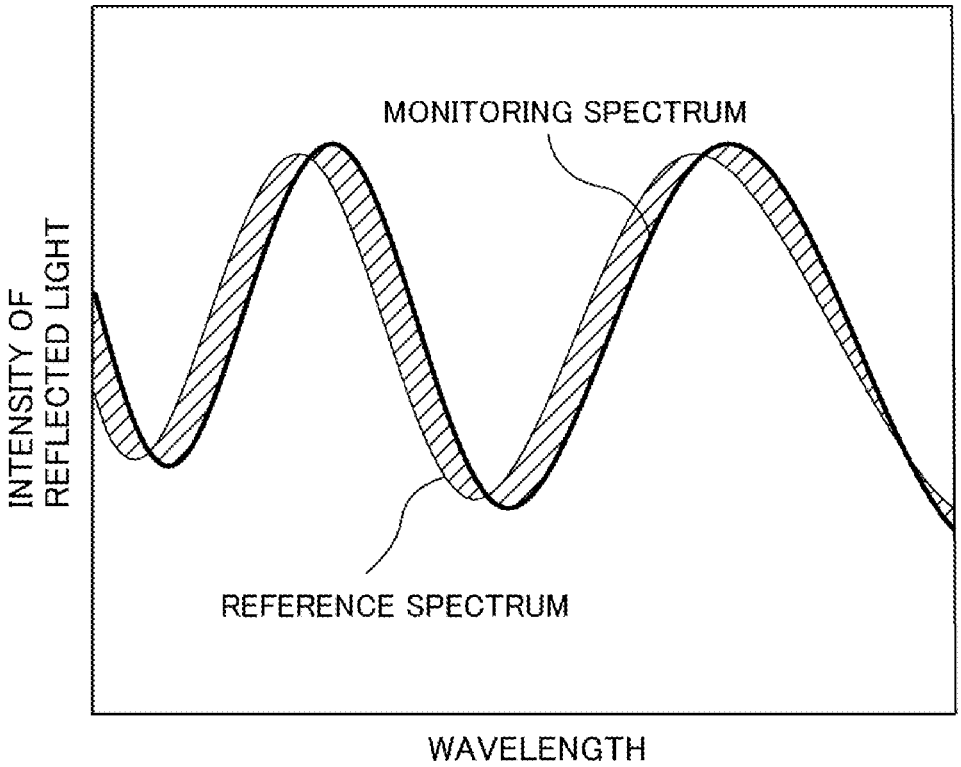
FIG. 5 is a graph showing an example of a monitoring spectrum and a reference spectrum.

FIG. 5 is a graph showing an example of the monitoring spectrum and the reference spectrum. In FIG. 5, vertical axis represents intensity of the reflected light, and horizontal axis represents wavelength of the reflected light. The intensity of the reflected light may be represented as a relative value, such as a reflectance or a relative reflectance. The reference history difference is a difference in shape between the monitoring spectrum and the reference spectrum, and corresponds to an area shown by a hatched pattern in FIG. 5. More specifically, the reference history difference is obtained by calculating an absolute value of a difference between an intensity of the reflected light represented by the monitoring spectrum and an intensity of the reflected light represented by the reference spectrum.

Figure 6:
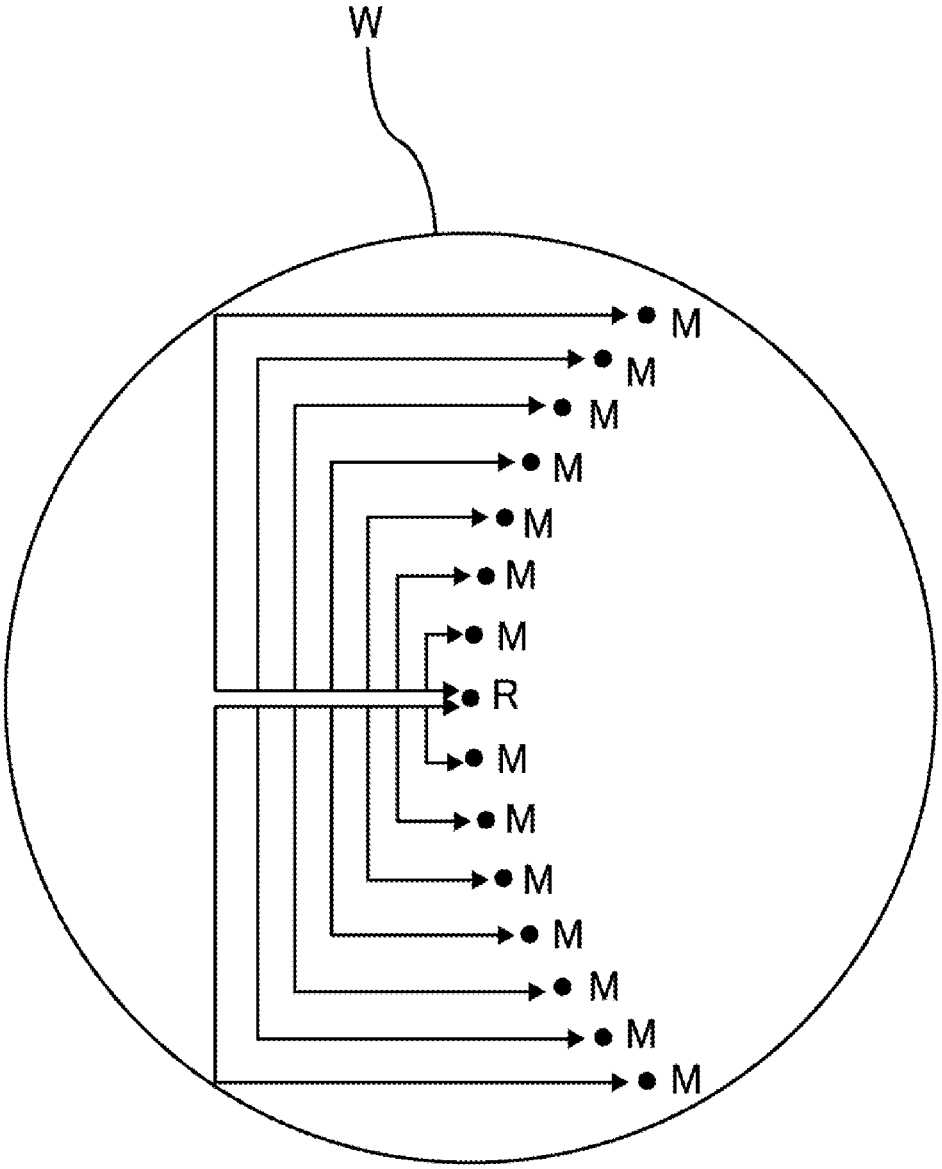
FIG. 6 is a diagram illustrating an embodiment of a process of calculating a plurality of reference history differences that are differences between a latest monitoring spectrum and a plurality of reference spectra in a reference spectrum history.

FIG. 6 is a diagram illustrating an embodiment of a process of calculating the plurality of reference history differences that are differences between the latest monitoring spectrum and the plurality of reference spectra in the reference spectrum history. The latest monitoring spectrum is the newest monitoring spectrum of the plurality of monitoring spectra obtained at each of the monitoring points M during polishing of the workpiece W. In the embodiment shown in FIG. 6, the reference spectrum is a spectrum of the reflected light from the reference point R located at the central point of the workpiece W. The optical sensor head 25 directs the light to the central point of the workpiece W each time the polishing table 3 makes one revolution, and therefore the position of the reference point R is fixed during polishing of the workpiece W.

As shown in FIG. 6, the processing system 30 determines the plurality of reference history differences corresponding to the plurality of reference spectra in the reference spectrum history by calculating a difference between the latest monitoring spectrum produced from the reflected light from each of the monitoring points M and each of the plurality of reference spectra in the reference spectrum history created for the reference point R. The plurality of reference history differences are calculated for each of the plurality of monitoring points M shown in FIG. 6.

Figure 7:
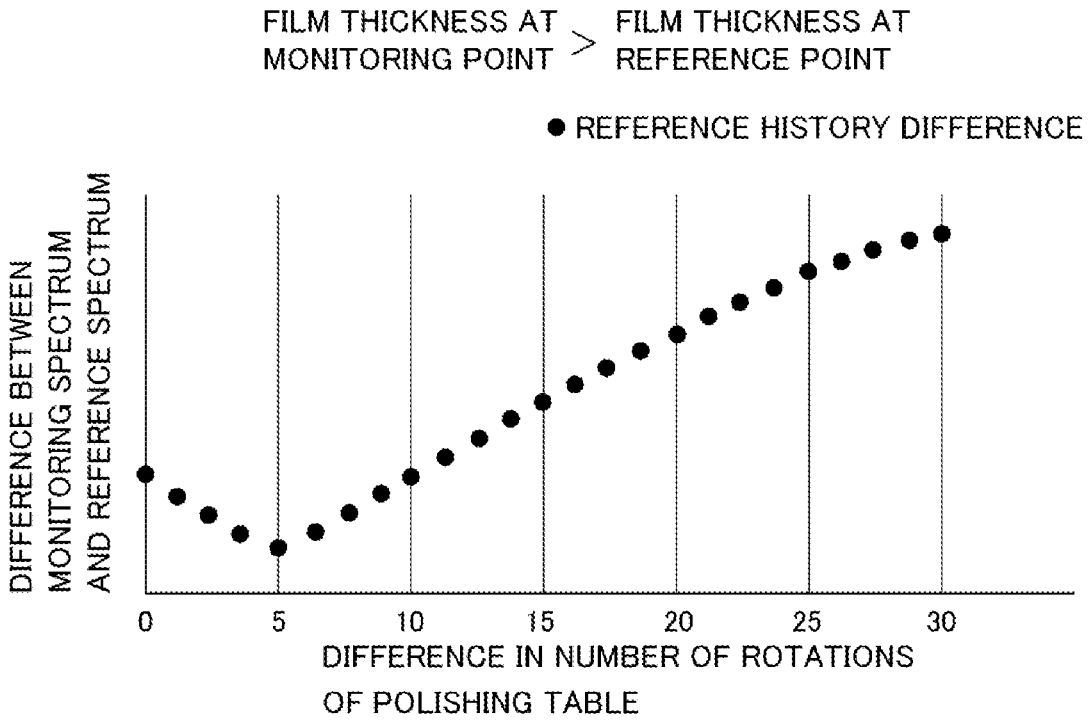
FIG. 7 is a graph showing an example of the plurality of reference history differences when film thicknesses at monitoring points are larger than a film thickness at a reference point.

FIG. 7 is a graph showing an example of the plurality of reference history differences that are differences between the latest monitoring spectrum and the plurality of reference spectra in the reference spectrum history. In FIG. 7, vertical axis represents difference between the latest monitoring spectrum and the reference spectrum, and horizontal axis represents difference in the number of rotations of the polishing table 3 that is a time difference between a point in time at which the latest monitoring spectrum has been produced and a point in time at which the reference spectrum for use in calculation of the reference history difference has been produced.

Since the monitoring spectrum and the reference spectrum are produced each time the polishing table 3 makes one rotation, the time difference between the latest monitoring spectrum and the reference spectrum in the reference spectrum history can be represented by the difference in the number of rotations of the polishing table 3. For example, in FIG. 7, the reference history difference when the difference in the number of rotations of the polishing table 3 is 0 is a difference between the latest monitoring spectrum and a latest reference spectrum. The reference history difference when the difference in the number of rotations of the polishing table 3 is 10 is a difference between the latest monitoring spectrum and a past reference spectrum having been produced at a past point in time corresponding to 10 rotations of the polishing table 3.

In the example in FIG. 7, a film thickness at the monitoring point M (see FIG. 6) at a point in time at which the latest monitoring spectrum has been produced is larger than a film thickness at the reference point R (see FIG. 6) at the same point in time. In this case, as shown in FIG. 7, there is a local minimum point of the plurality of reference history differences that are the differences between the latest monitoring spectrum and the plurality of reference spectra in the reference spectrum history. In the example shown in FIG. 7, when the difference in the number of rotations of the polishing table 3 is five, there is the local minimum point of the reference history difference. This means that a shape of the latest monitoring spectrum is closest to a shape of a past reference spectrum having been produced at a past point in time corresponding to five rotations of the polishing table 3.

During polishing of the workpiece W, the processing system 30 then compares the reference spectrum produced from the reflected light from the reference point R with the plurality of monitoring spectra in the monitoring spectrum history created for each of the monitoring points M as shown in FIG. 6. Specifically, the processing system 30 calculates a plurality of monitoring history differences that are differences between a latest reference spectrum in the reference spectrum history and the plurality of monitoring spectra in the monitoring spectrum history created for each of the monitoring points M.

Each of the plurality of monitoring history differences is a difference in shape between the latest reference spectrum and each of the monitoring spectra in the monitoring spectrum history. As described with reference to FIG. 5, the monitoring history difference is determined by calculating the absolute value of the difference between the intensity of the reflected light represented by the reference spectrum and the intensity of the reflected light represented by the monitoring spectrum. The latest reference spectrum is the newest reference spectrum of the plurality of reference spectra obtained during polishing of the workpiece W.

As shown in FIG. 6, the processing system 30 determines the plurality of monitoring history differences corresponding to the plurality of monitoring spectra in the monitoring spectrum history created for each monitoring point M by calculating a difference between the latest reference spectrum produced from the reflected light from the reference point R and each of the plurality of monitoring spectra in the monitoring spectrum history created for each monitoring point M. The plurality of monitoring history differences are calculated for each of the plurality of monitoring points M shown in FIG. 6.

Figure 8:
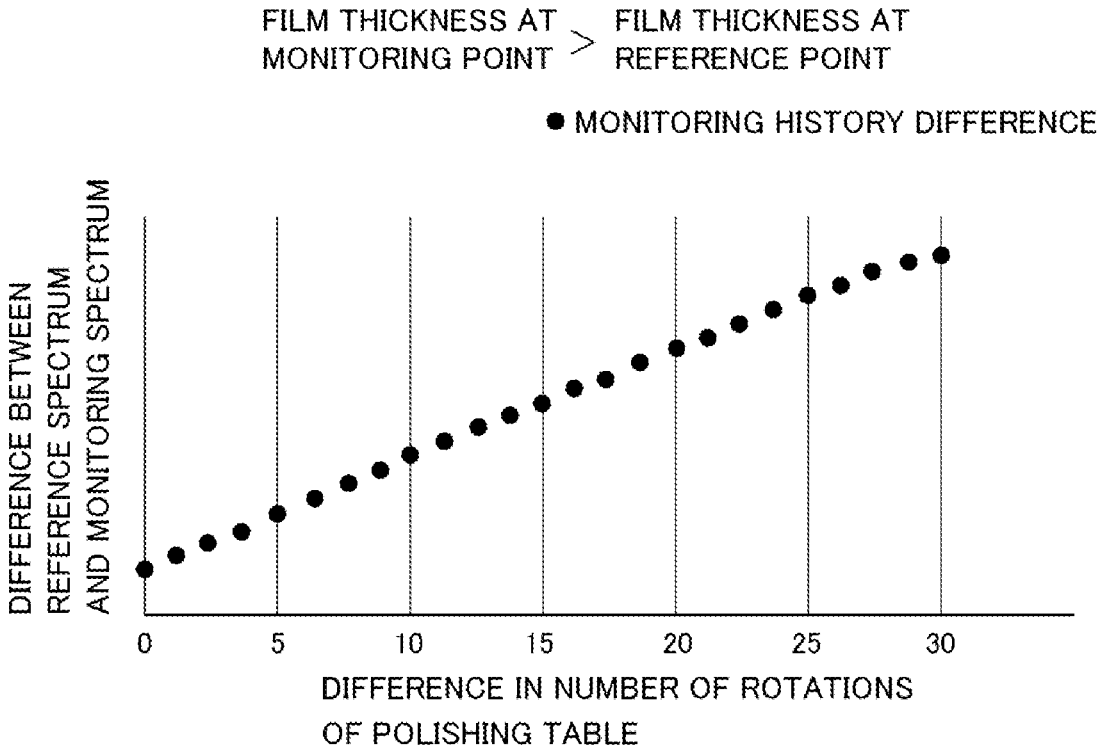
FIG. 8 is a graph showing an example of a plurality of monitoring history differences when the film thicknesses at the monitoring points are larger than the film thickness at the reference point.

FIG. 8 is a graph showing an example of the plurality of monitoring history differences that are the differences between the latest reference spectrum and the plurality of monitoring spectra in the monitoring spectrum history. In FIG. 8, vertical axis represents difference between the latest reference spectrum and the monitoring spectrum, and horizontal axis represents difference in the number of rotations of the polishing table 3 that is a time difference between a point in time at which the latest reference spectrum has been produced and a point in time at which the monitoring spectrum for use in calculation of the monitoring history difference has been produced.

Since the reference spectrum and the monitoring spectrum are produced each time the polishing table 3 makes one revolution, the time difference between the latest reference spectrum and the monitoring spectrum can be represented by the difference in the number of rotations of the polishing table 3. For example, in FIG. 8, the monitoring history difference when the difference in the number of rotations of the polishing table 3 is 0 is a difference between the latest reference spectrum and the latest monitoring spectrum. The monitoring history difference when the difference in the number of rotations of the polishing table 3 is 10 is a difference between the latest reference spectrum and a past monitoring spectrum having been produced at a past point in time corresponding to 10 rotations of the polishing table 3.

In the example in FIG. 8, a film thickness at the monitoring point M (see FIG. 6) at a point in time at which the latest reference spectrum has been produced is larger than a film thickness at the reference point R (see FIG. 6) at the same time. In this case, as shown in FIG. 8, the difference between the latest reference spectrum and each monitoring spectrum in the monitoring spectrum history increases with the time difference (i.e., with the difference in the number of rotations of the polishing table 3). As a result, there is no local minimum point of the monitoring history differences.

As can be seen from FIGS. 7 and 8, the presence of the local minimum point of the reference history differences means that the film thickness at the monitoring point M is larger than the film thickness at the reference point R at the point in time at which the latest monitoring spectrum and the latest reference spectrum have been produced.

The processing system 30 can calculate a film-thickness difference between the monitoring point M and the reference point R from a polishing rate of the workpiece W and a time difference between a past point in time corresponding to the local minimum point of the reference history difference and the point in time at which the latest monitoring spectrum and the latest reference spectrum have been produced. More specifically, the processing system 30 calculates the film-thickness difference between the monitoring point M and the reference point R by multiplying the time difference (in the example shown in FIG. 7, the time corresponding to five rotations of the polishing table 3) by a temporary polishing rate of the workpiece W. The temporary polishing rate of the workpiece W is a preset polishing rate, which is determined in advance based on polishing environment, such as a pressing force of the polishing head 1 against the workpiece W, a rotation speed of the polishing head 1, a rotation speed of the polishing table 3, a material of the film constituting the surface of the workpiece W, a type of the polishing liquid, etc.

Figure 9:
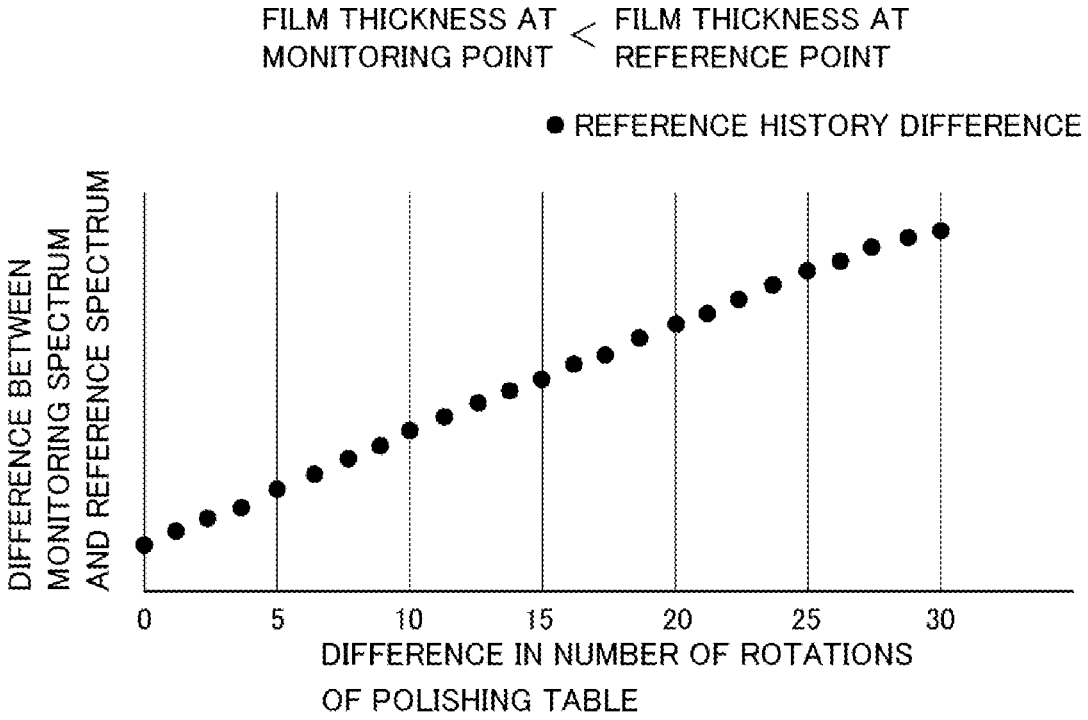
FIG. 9 is a graph showing an example of the plurality of reference history differences when the film thicknesses at the monitoring points are smaller than the film thickness at the reference point.
Figure 10:
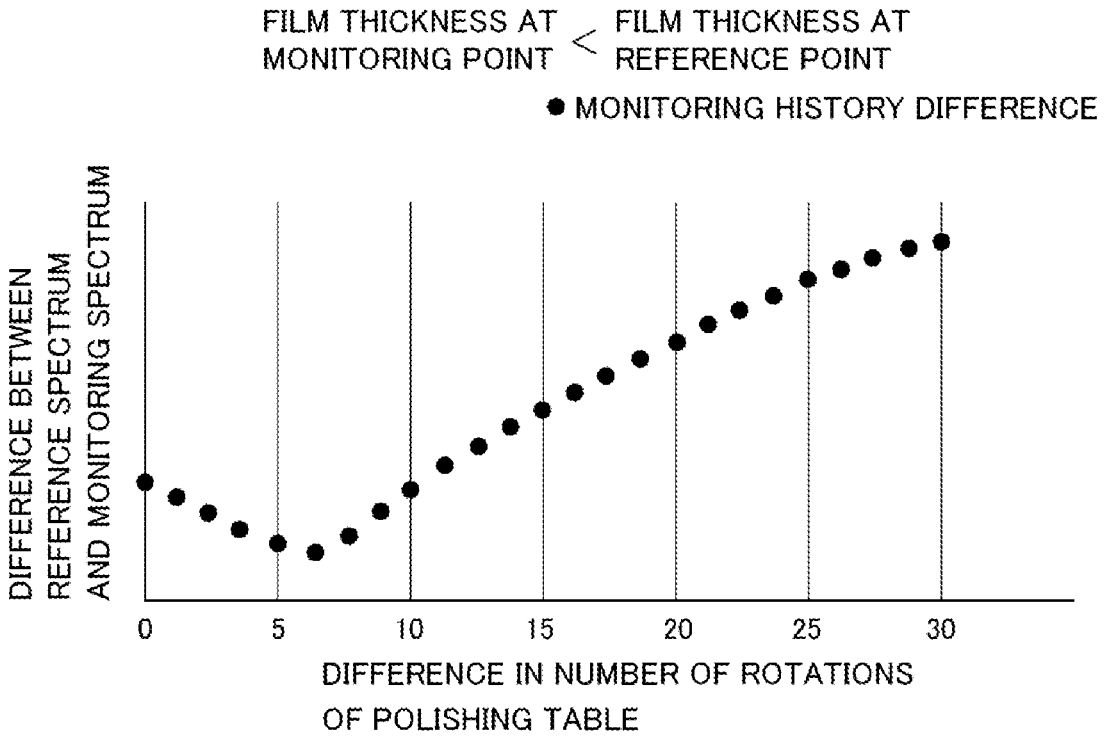
FIG. 10 is a graph showing an example of the plurality of monitoring history differences when the film thicknesses at the monitoring points are smaller than the film thickness at the reference point.

FIG. 9 is a graph showing an example of the plurality of reference history differences when the film thickness at the monitoring point M is smaller than the film thickness at the reference point R at the point in time at which the latest monitoring spectrum and the latest reference spectrum have been produced. FIG. 10 is a graph showing an example of the plurality of monitoring history differences when the film thickness at the monitoring point M is smaller than the film thickness at the reference point R at the point in time at which the latest monitoring spectrum and the latest reference spectrum have been produced.

As shown in FIGS. 9 and 10, when the film thickness at the monitoring point M is smaller than the film thickness at the reference point R, there is no local minimum point of the reference history differences. On the other hand, there is a local minimum point of the monitoring history differences. In other words, the absence of the local minimum point of the reference history differences and the existence of the local minimum point of the monitoring history differences means that the film thickness at the monitoring point M is smaller than the film thickness at reference point R at the point in time at which the latest monitoring spectrum and the latest reference spectrum have been produced. In the example shown in FIG. 10, when the difference in the number of rotations of the polishing table 3 is six, there is the local minimum point of the monitoring history difference. This means that a shape of the latest reference spectrum is closest to a shape of a past monitoring spectrum having been produced at a past point in time corresponding to six rotations of the polishing table 3.

The processing system 30 can calculate a film-thickness difference between the monitoring point M and the reference point R from the polishing rate of the workpiece W and a time difference between a past point in time corresponding to the local minimum point of the monitoring history difference and the point in time at which the latest monitoring spectrum and the latest reference spectrum have been produced. More specifically, the processing system 30 calculates the film-thickness difference between the monitoring point M and the reference point R by multiplying the time difference (in the example shown in FIG. 10, the time corresponding to six rotations of the polishing table 3) by the temporary polishing rate of the workpiece W.

Figure 11:
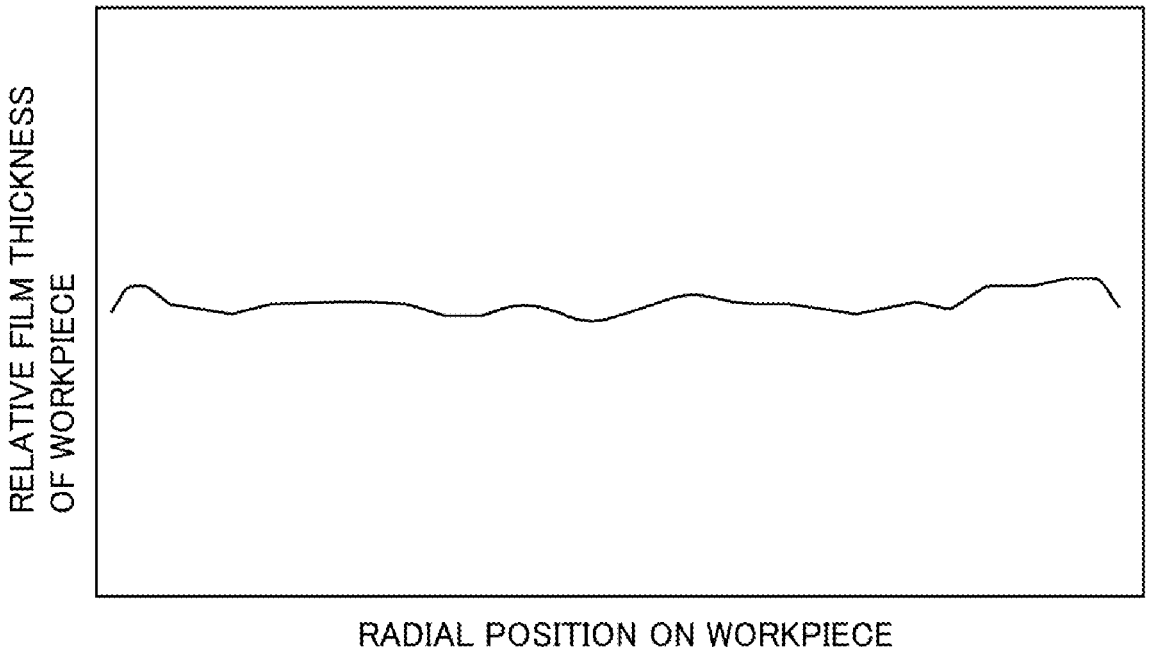
FIG. 11 is a schematic diagram showing an example of a relative-film-thickness profile of the workpiece.

The processing system 30 is configured to determine a plurality of film-thickness differences by calculating the film-thickness difference for each of the plurality of monitoring points M on the workpiece W shown in FIG. 6, and is configured to create a relative-film-thickness profile of the workpiece W based on the plurality of film-thickness differences. More specifically, the processing system 30 creates a relative-film-thickness profile as shown in FIG. 11 during polishing of the workpiece W by sequentially connecting the plurality of film-thickness differences calculated for the plurality of monitoring points M shown in FIG. 6, respectively. In FIG. 11, vertical axis represents a relative film thickness of the workpiece W, and horizontal axis represents a radial position on the workpiece W. The relative film thickness of the workpiece W is a relative film thickness at the monitoring point M with respect to a film thickness at the reference point R.

The processing system 30 transmits the relative-film-thickness profile to the operation controller 9. The operation controller 9 is configured to adjust the pressing force of the polishing head 1 against the workpiece W during polishing of the workpiece W based on the relative-film-thickness profile.

According to the embodiments described above, it is not necessary to polish another workpiece in advance in order to obtain the reference spectrum. Furthermore, an influence of a lower layer, which exists underneath the film constituting the surface of the workpiece W, is canceled by calculating the difference between the reference spectrum and the monitoring spectrum. Therefore, measuring of the film-thickness of the workpiece W is less affected by the variation in the lower layer.

Figure 12:
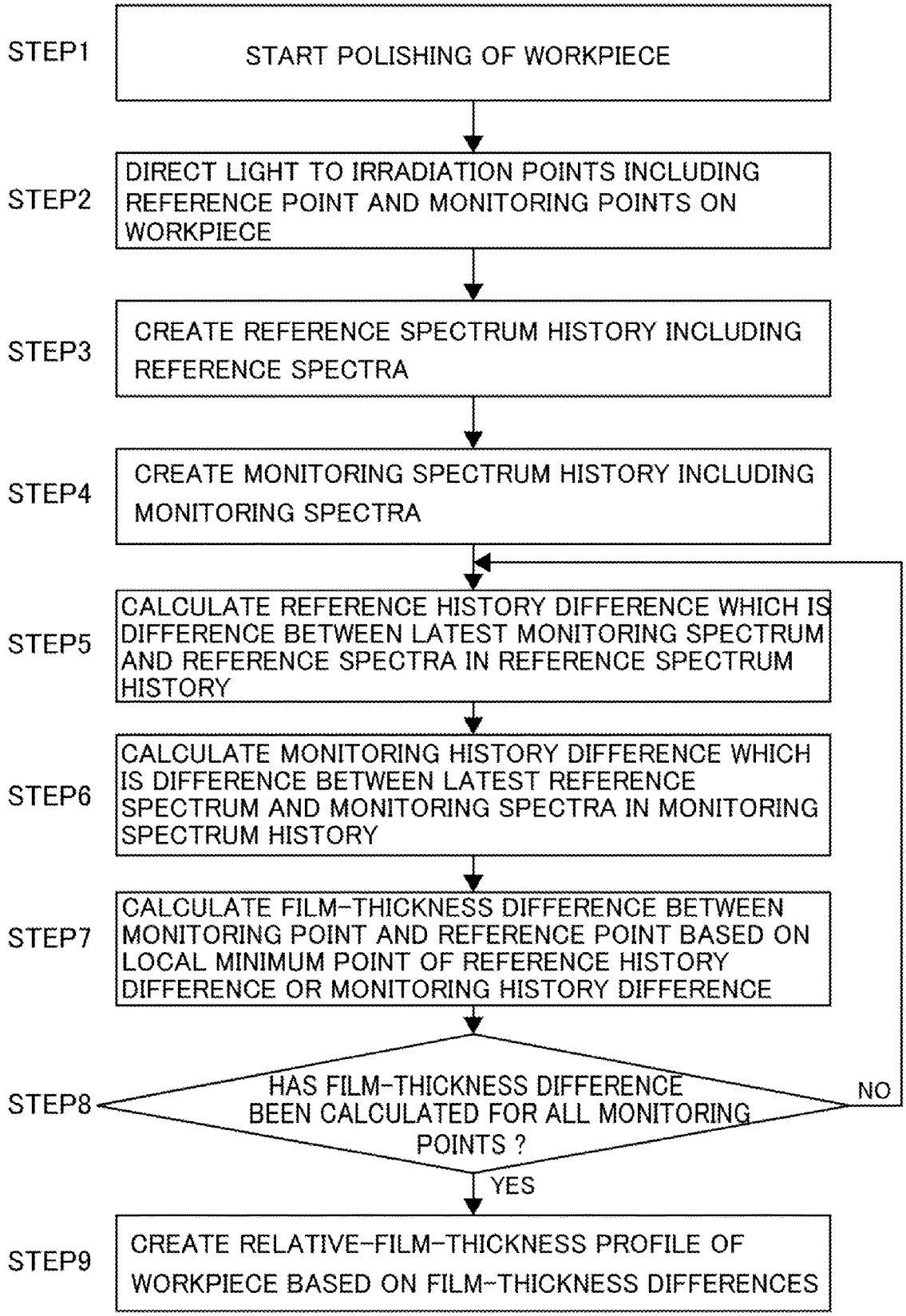
FIG. 12 is a flowchart illustrating an embodiment of a polishing method.

FIG. 12 is a flowchart illustrating an embodiment of a method of polishing the workpiece W while creating the relative-film-thickness profile.

In step 1, the operation controller 9 instructs the polishing head 1, the table motor 6, the polishing-liquid supply nozzle 5, the polishing-head rotating device 15 of the polishing apparatus to press the workpiece W against the polishing pad 2 by the polishing head 1 while the polishing table 3 supporting the polishing pad 2 is rotated, and the polishing liquid is supplied onto the polishing pad 2, so that polishing of the workpiece W is started.

In step 2, the operation controller 9 instructs the light source 22 to direct the light from the optical sensor head 25 to the plurality of irradiation points including the reference point R and the monitoring points M on the workpiece W during polishing of the workpiece W.

In step 3, the processing system 30 creates the reference spectrum history including the plurality of reference spectra by repeatedly producing the reference spectrum at predetermined time intervals during polishing of the workpiece W.

In step 4, the processing system 30 creates the monitoring spectrum history including the plurality of monitoring spectra by repeatedly producing the monitoring spectrum at predetermined time intervals during polishing of the workpiece W. The step 3 and the step 4 may be performed simultaneously, at different times, or in overlapping times. The step 4 may be performed before the step 3.

In step 5, the processing system 30 calculates the plurality of reference history differences that are differences between the latest monitoring spectrum and the plurality of reference spectra in the reference spectrum history.

In step 6, the processing system 30 calculates the plurality of monitoring history differences that are differences between the latest reference spectrum and the plurality of monitoring spectra in the monitoring spectrum history. The step 5 and the step 6 may be performed simultaneously, at different times, or in overlapping times. The step 6 may be performed before the step 5.

In step 7, the processing system 30 calculates the film-thickness difference between the monitoring point and the reference point based on the local minimum point of the reference history difference or the monitoring history difference that exists in either the plurality of reference history differences or the plurality of monitoring history differences. More specifically, the processing system 30 determines the local minimum point of the reference history difference or the local minimum point of the monitoring history difference that exists in either the plurality of reference history differences or the plurality of monitoring history differences, determines a time difference between a past point in time corresponding to the local minimum point and a point in time at which the latest monitoring spectrum or the latest reference spectrum has been produced, and calculates the film-thickness difference between the monitoring point and the reference point by multiplying the determined time difference by the temporary polishing rate of the workpiece W. The temporary polishing rate is a predetermined polishing rate.

In step 8, the processing system 30 determines a plurality of film-thickness differences by repeating the steps 5 to 7 until film-thickness differences are calculated for all monitoring points M on the workpiece W.

In step 9, the processing system 30 creates a relative-film-thickness profile of the workpiece W based on the plurality of film-thickness differences determined in the step 8.

The steps 2 to 9 are performed during polishing of the workpiece W.

The operation controller 9 and the processing system 30 operate according to instructions contained in the programs electrically stored in their memories 9*a* and 30*a*, respectively, and perform the steps 1 to 9. The programs for causing the operation controller 9 and the processing system 30 to perform these steps are stored in a non-transitory tangible computer-readable storage medium, and are provided to the operation controller 9 and the processing system 30 via the storage medium. Alternatively, the programs may be provided to the operation controller 9 and the processing system 30 via a communication network, such as the Internet or a local area network. The operation controller 9 and the processing system 30 may be configured integrally. For example, the operation controller 9 and the processing system 30 may be composed of one computer. In another example, the operation controller 9 and the processing system 30 may be composed of a plurality of computers.

Next, another embodiment of creating the relative-film-thickness profile of the workpiece W will be described with reference to FIG. 13. Configurations and operations of this embodiment, which will not be particularly described, are the same as those of the embodiments described with reference to FIGS. 1 to 12, and duplicated descriptions will be omitted.

Figure 13:
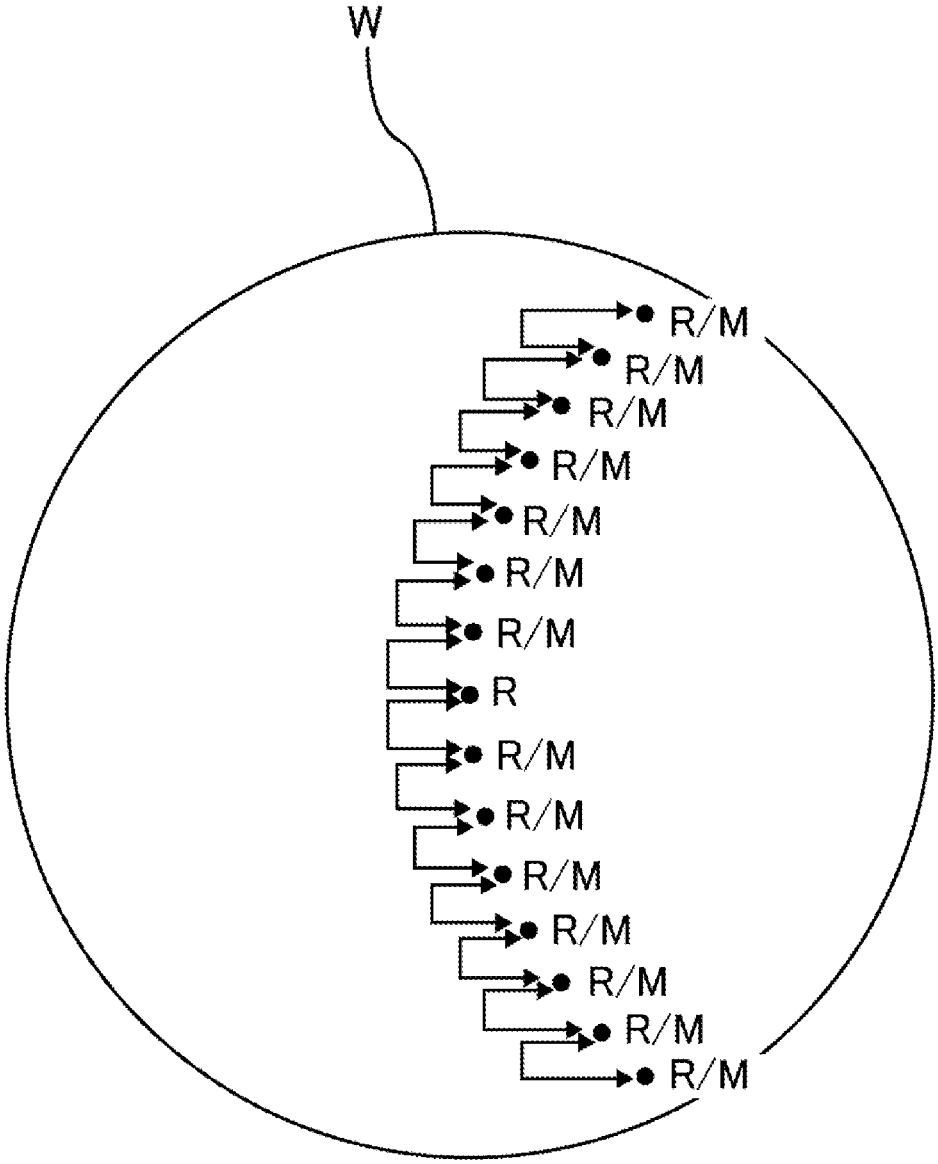
FIG. 13 is a diagram illustrating another embodiment of creating the relative-film-thickness profile of the workpiece.

As shown in FIG. 13, the reference point R and the monitoring point M are two adjacent points of the plurality of irradiation points to which the light is directed from the optical sensor head 25 (see FIG. 1). In the example shown in FIG. 13, the irradiation point on the central point of the workpiece W is the reference point R, and the other irradiation points are both the reference point R and the monitoring point M. In the embodiment described with reference to FIG. 6, the reference point R is on the central point of the workpiece W, and the position of the reference point R is fixed, while in the embodiment shown in FIG. 13, the reference point R moves one by one within the plurality of irradiation points as the monitoring point M moves. Therefore, the reference point R and the monitoring point M, which are the two adjacent points, move one by one within the plurality of irradiation points.

The flowchart shown in FIG. 12 can be applied to the embodiment described with reference to FIG. 13, while the steps 5 to 8 in FIG. 12 are performed while the reference point R and the monitoring point M are shifted one by one within the plurality of irradiation points on the workpiece W.

In this embodiment, the processing system 30 can also create the relative-film-thickness profile as shown in FIG. 11 during polishing of the workpiece W. The processing system 30 transmits the relative-film-thickness profile to the operation controller 9, and the operation controller 9 adjusts the pressing force of the polishing head 1 against the workpiece W based on the relative-film-thickness profile during polishing of the workpiece W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing method comprising:

polishing a workpiece by pressing the workpiece against a polishing pad while rotating a polishing table supporting the polishing pad;

directing light to irradiation points including a reference point and a monitoring point on the workpiece during polishing of the workpiece;

during polishing of the workpiece, creating a reference spectrum history including a plurality of reference spectra by repeatedly producing a reference spectrum that is a spectrum of reflected light from the reference point on the workpiece;

during polishing of the workpiece, creating a monitoring spectrum history including a plurality of monitoring spectra by repeatedly producing a monitoring spectrum that is a spectrum of reflected light from the monitoring point on the workpiece;

calculating a plurality of reference history differences that are differences between a latest monitoring spectrum and the plurality of reference spectra in the reference spectrum history;

calculating a plurality of monitoring history differences that are differences between a latest reference spectrum and the plurality of monitoring spectra in the monitoring spectrum history;

calculating a film-thickness difference between the monitoring point and the reference point based on a local minimum point of a reference history difference or a monitoring history difference that exists in either the plurality of reference history differences or the plurality of monitoring history differences;

determining a plurality of film-thickness differences by calculating the film-thickness difference for a plurality of monitoring points on the workpiece; and creating a relative-film-thickness profile of the workpiece based on the plurality of film-thickness differences.

2. The polishing method according to claim 1, wherein the reference point comprises a central point of the workpiece.

3. The polishing method according to claim 1, wherein the reference point and the monitoring point comprise two adjacent points of the irradiation points.

4. The polishing method according to claim 3, wherein determining the plurality of film-thickness differences for the plurality of monitoring points comprises determining the plurality of film-thickness differences by calculating the film-thickness difference for the plurality of monitoring points on the workpiece while shifting the reference point and the monitoring point, which are adjacent, one by one within the irradiation points.

5. The polishing method according to claim 1, wherein calculating the film-thickness difference between the monitoring point and the reference point comprises:

determining the local minimum point of the reference history difference or the monitoring history difference that exists in either the plurality of reference history differences or the plurality of monitoring history differences;

determining a time difference between a past point in time corresponding to the local minimum point and a point in time at which the latest monitoring spectrum or the latest reference spectrum has been produced; and calculating the film-thickness difference by multiplying the time difference by a temporary polishing rate of the workpiece.

6. The polishing method according to claim 1, wherein the workpiece comprises a product wafer.

7. A computer-readable storage medium storing a program for causing a computer to perform the steps of:

instructing a light source to direct light to irradiation points including a reference point and a monitoring point on a workpiece during polishing of the workpiece;

during polishing of the workpiece, creating a reference spectrum history including a plurality of reference spectra by repeatedly producing a reference spectrum that is a spectrum of reflected light from the reference point on the workpiece;

during polishing of the workpiece, creating a monitoring spectrum history including a plurality of monitoring spectra by repeatedly producing a monitoring spectrum that is a spectrum of reflected light from the monitoring point on the workpiece;

calculating a plurality of reference history differences that are differences between a latest monitoring spectrum and the plurality of reference spectra in the reference spectrum history;

calculating a plurality of monitoring history differences that are differences between a latest reference spectrum and the plurality of monitoring spectra in the monitoring spectrum history;

calculating a film-thickness difference between the monitoring point and the reference point based on a local minimum point of a reference history difference or a monitoring history difference that exists in either the plurality of reference history differences or the plurality of monitoring history differences;

determining a plurality of film-thickness differences by calculating the film-thickness difference for a plurality of monitoring points on the workpiece; and creating a relative-film-thickness profile of the workpiece based on the plurality of film-thickness differences.

8. The computer-readable storage medium storing the program according to claim 7, wherein calculating the film-thickness difference between the monitoring point and the reference point comprises:

determining the local minimum point of the reference history difference or the monitoring history difference that exists in either the plurality of reference history differences or the plurality of monitoring history differences;

determining a time difference between a past point in time corresponding to the local minimum point and a point in time at which the latest monitoring spectrum or the latest reference spectrum has been produced; and calculating the film-thickness difference by multiplying the time difference by a temporary polishing rate of the workpiece.

9. A polishing apparatus comprising:

a polishing table configured to support a polishing pad;

a table motor configured to rotate the polishing table;

a polishing head configured to polish a workpiece by pressing the workpiece against the polishing pad;

a light source and an optical sensor head configured to direct light to irradiation points including a reference point and a monitoring point on the workpiece during polishing of the workpiece; and a processing system having a memory storing a program therein and an arithmetic device configured to perform an arithmetic operation according to an instruction contained in the program, wherein the processing system is configured to:

create a reference spectrum history including a plurality of reference spectra by repeatedly producing a reference spectrum that is a spectrum of reflected light from the reference point on the workpiece during polishing of the workpiece;

create a monitoring spectrum history including a plurality of monitoring spectra by repeatedly producing a monitoring spectrum that is a spectrum of reflected light from the monitoring point on the workpiece during polishing of the workpiece;

calculate a plurality of reference history differences that are differences between a latest monitoring spectrum and the plurality of reference spectra in the reference spectrum history;

calculate a plurality of monitoring history differences that are differences between a latest reference spectrum and the plurality of monitoring spectra in the monitoring spectrum history;

calculate a film-thickness difference between the monitoring point and the reference point based on a local minimum point of a reference history difference or a monitoring history difference that exists in either the plurality of reference history differences or the plurality of monitoring history differences;

determine a plurality of film-thickness differences by calculating the film-thickness difference for a plurality of monitoring points on the workpiece; and create a relative-film-thickness profile of the workpiece based on the plurality of film-thickness differences.

10. The polishing apparatus according to claim 9, wherein the processing system is configured to:

determine the local minimum point of the reference history difference or the monitoring history difference that exists in either the plurality of reference history differences or the plurality of monitoring history differences;

determine a time difference between a past point in time corresponding to the local minimum point and a point in time at which the latest monitoring spectrum or the latest reference spectrum has been produced; and calculate the film-thickness difference by multiplying the time difference by a temporary polishing rate of the workpiece.

* * * * *